US006308135B1

(12) United States Patent
Hocking

(10) Patent No.: US 6,308,135 B1
(45) Date of Patent: Oct. 23, 2001

(54) SOIL LIQUEFACTION PREVENTION BY ELECTRO-OSMOSIS DURING AN EARTHQUAKE EVENT

(75) Inventor: Grant Hocking, Alpharetta, GA (US)

(73) Assignee: Golder Sierra LLC, Atlanta, GA (US)

( * ) Notice: Subject to any disclaimer, the term of this patent is extended or adjusted under 35 U.S.C. 154(b) by 0 days.

(21) Appl. No.: 09/670,603

(22) Filed: Sep. 26, 2000

Related U.S. Application Data

(60) Provisional application No. 60/158,272, filed on Oct. 7, 1999.

(51) Int. Cl.[7] ..... G01V 7/00

(52) U.S. Cl. ..... 702/2; 405/36; 367/60

(58) Field of Search ..... 702/2; 405/36; 240/180; 210/747; 367/60

(56) References Cited

U.S. PATENT DOCUMENTS

| | | | | |
|---|---|---|---|---|
| 3,915,826 | | 10/1975 | Franceschini | 204/180 R |
| 4,960,524 | | 10/1990 | Inculet et al. | 210/747 |
| 5,800,090 | | 9/1998 | Goughnour | 405/36 |
| 6,181,841 | * | 1/2001 | Hodge | 385/12 |
| 6,216,783 | * | 4/2001 | Hocking et al. | 166/250.1 |

FOREIGN PATENT DOCUMENTS

| | | |
|---|---|---|
| 228601 | 9/1942 | (CH) . |
| 0 870 875 | 10/1998 | (EP) . |
| 2 175 609 | 12/1986 | (GB) . |
| WO 98/59117 | 12/1998 | (WO) . |

* cited by examiner

*Primary Examiner*—Hezron Williams
*Assistant Examiner*—Victor J. Taylor
(74) *Attorney, Agent, or Firm*—Smith, Gambrell & Russell, LLP

(57) ABSTRACT

A method and system of preventing soil liquefaction beneath a structure during an earthquake event, by monitoring local seismic precursor events, such as early arrival ground motion using an accelerometer, predicting the onset of a major earthquake tremor, and energizing conductors in the ground by a d-c power source for moving the ground water by electro-osmosis away from the foundation of the structure or to a series of pressure relief wells, whereby lowering the soil pore water pressure and preventing liquefaction of the soil beneath the structure.

14 Claims, 5 Drawing Sheets

SOIL LIQUEFACTION PREVENTION BY ELECTRO-OSMOSIS DURING AN EARTHQUAKE EVENT

RELATED APPLICATION

This is a nonprovisional application claiming priority from provisional application Ser. No. 60/158,272, filed Oct. 7, 1999.

TECHNICAL FIELD

This invention relates to soil stabilization, and more particularly to the prevention of earthquake induced soil liquefaction to minimize damage to supported structures or works by reducing earthquake induced pore water pressures by applying an electro-osmotic gradient to the saturated soil during the earthquake event.

BACKGROUND OF THE INVENTION

Earthquakes are caused by the resultant relative slippage of the earth crust, generally along or near major tectonic plate boundaries. In certain parts of the world, continuous differential movement occurs between one section of the earth's crust and an adjacent one, causing an accumulation of strain at the boundary. When the stresses caused by this strain accumulation exceed the strength of the earth's materials, a slip occurs between two portions of the earth's crust and tremendous amounts of energy are released. This energy propagates outward from the focus or origin of the earthquake in the form of body and surface elastic stress waves.

The energy released during an earthquake event is transmitted through the earth's crust in the form of body and surface seismic waves. The body waves are composed of P-(compression) waves and S-(shear) waves, with the P-wave traveling significantly faster than the S-wave. The surface waves of most interest are the Rayleigh wave and the Love wave. The Love wave travels faster than the Rayleigh wave. The total energy transported is represented almost entirely by the Rayleigh, the S- and the P-waves, with the Rayleigh wave carrying the largest amount of energy, the S-wave an intermediate amount and the P-wave the least. The velocity of the P-wave is almost double that of the S-wave, and the velocity of the S-wave is only slightly greater than the Rayleigh wave.

At some distance from an earthquake disturbance a particle at the earth's surface first experiences a displacement in the form of an oscillation at the arrival of the P-wave followed by a relatively quiet period leading up to another oscillation at the arrival of the S- and Rayleigh waves. These events are referred to as the minor tremor and the major tremor at the time of arrival of the Rayleigh wave. The body and surface waves are monitored during an earthquake to gauge the earthquake's intensity.

Earth ground motions experienced during an earthquake are actually quite complex due to the variation in the earth's crust, from strong stiff bedrock to soft weak soils. Considerable energy can be transmitted through the bedrock, and it appears that in many cases the main forces acting on soil elements in the field during earthquakes are those resulting from the upward migration of shear motions from the underlying rock formations. Although the actual wave pattern may be very complex, the resulting repeated and reversing shearing deformations, imposed on the soil by the S-wave components are the principal cause of liquefaction in saturated fine sand or silty sand deposits. When these soil deposits are subjected to repeated shear strain reversals, the volume of the soil decreases with each cycle, i.e. the soil contracts, and due to the lack of drainage of these saturated soils, the soil pore water pressure rises. As the soil pore water pressure rises, the grain to grain contact pressure becomes smaller, until eventually the grain to grain contact pressure drops to zero and the soil loses all of its shear strength and acts like a fluid. This phenomenon is known as liquefaction and can occur in loose saturated fine sands and silty sands as a result of earthquakes, blasting or other shocks.

The factors that effect the occurrence of liquefaction are soil type, grain size distribution, compactness of the soil, soil permeability, magnitude and number of the strain reversals. Fine cohesionless soils, fine sand or fine cohesionless soils containing moderate amounts of silt are most susceptible to liquefaction. Uniformly graded soils are more susceptible to liquefaction than well graded soils, and fine sands tend to liquefy more easily than coarse sands or gravelly soils. Moderate amounts of silt appear to increase the liquefaction susceptibility of fine sands; however, fine sands with large amounts of silt are less susceptible, although liquefaction is still possible. Recent evidence indicates that sands containing moderate amounts of clay may also be liquefiable.

In very coarse sands or gravel ground water can flow freely enough that pore water pressures never become dangerously high to give rise to liquefaction. Fine sands and silty sands however have moderate to low permeability, which prevents the dissipation of induced pore water pressures and results in liquefaction of the soil. If the soil pore water pressures generated during an earthquake event can be relieved then the soil will not liquefy and hence will remain stable.

The temporary loss of shear strength resulting during liquefaction can have a catastrophic effect on earthworks or structures supported on such soils. Major landslides, settling or tilting of buildings and bridges and instability of dams or tailings ponds have all been observed in recent years and efforts have been directed to prevent or reduce such damage.

Conventional soil stabilization methods to minimize or prevent liquefaction consist of one of five general methods:

1) remove liquefaction prone soil material and replace with sound material, 2) provide structural support to underlying firm soil strata, e.g. piling, 3) densify the soil to render it less susceptible to liquefaction, 4) strengthen the liquefaction prone soils, 5) provide drainage to prevent build up of soil pore water pressures, e.g. stone or gravel columns or relief wells.

The above methods have proven successful in minimizing liquefaction related damage; however, they are expensive, difficult to implement in existing structures and some of the methods are severely limited in their effectiveness in fine grain soils.

Under certain static soil conditions, soil stabilization may be achieved by electro-osmosis. Electro-osmosis involves the application of a constant, low d-c current between electrodes inserted in the saturated soil, that gives rise to pore fluid movement from the source electrodes towards the sink electrodes and thus modifies the soil pore water pressures. Electro-osmosis has been used in applications such as 1) improving stability of excavations, 2) decreasing pile driving resistance, 3) increasing pile strength, 4) stabilization of soils by consolidation or grouting, 5) dewatering of sludges, 6) groundwater lowering and barrier systems, 7) increasing petroleum production and 8) removing contaminants from soils. Electro-osmosis uses a low level d-c electrical potential difference applied across the saturated soil mass by electrodes placed in an open or closed flow arrangement. The d-c potential difference sets up a low level constant d-c current flowing from the source electrodes to the sink electrodes. In most soils the soil particles have a negative charge. For those negatively charged soils, the source electrode is the anode electrode, the sink electrode is the cathode electrode, and ground water migrates from the anode electrode toward the cathode electrode. In other soils, such as calcareous soils (e.g. limestone), the soil particles carry a positive charge. In those positively charged soils, the source electrode is the cathode electrode, the sink electrode is the anode electrode, and ground water migrates from the cathode electrode toward the anode electrode.

An "open" flow arrangement at the electrodes allows an ingress or egress of the pore fluid. Due to the electrically induced transport of pore water fluid, the soil pore water pressures are modified to enable excavations to be stabilized or pile driving resistance to be lowered. Electro-osmosis is not used extensively due to the high cost of maintaining the d-c potential over long periods of time and the drying out and chemical reactions that occur if the system is activated for long periods of time. For short term stabilization by pore water pressure reduction, electro-osmosis is very effective in fine grained soils, such as fine sands, silty sands and silts.

Because of the damage caused by earthquakes, various methods of forecasting earthquakes have been attempted in order to reduce damage and loss of life. Forecasting an impending earthquake requires an identification and monitoring of physical parameters which are often referred to as precursors of seismic activity. Monitoring the early arrival ground motion due to seismic waves using accelerometers has enabled real time forecasting of an impending major earthquake tremor, but such forecasting only provides warnings by a matter of generally seconds although sometimes up to a minute. Such forecasting does not provide timely warning of an impending earthquake to allow evacuation or other normal emergency preparation, and considerable effort has been directed to forecasting an impending earthquake from monitoring other activities, such as changes in animal behavior, build-up of strain in the rocks of the earth's crust, changes in P-wave velocities, uplift and tilt of the earth, changes in ground water levels in wells, increases in the emission of radon gas, and changes in the earth's resistivity, magnetic and electromagnetic fields or currents. These other more timely methods of forecasting impending earthquakes are currently not sufficiently precise to predict the onset of an earthquake or a major earthquake tremor.

Monitoring ground motion and activating safety devices prior to the arrival of a major earthquake tremor can in some cases reduce damage. Such a forecasting system can be used to close gas valves or cutoff electricity to the effected area. Such systems may include a tuned pendulum system, that upon the onset of certain ground motion magnitude and frequency, the pendulum motion sets off an alarm, activates a switch or closes a gas valve prior to the arrival of the major tremor of the earthquake. Alternatively, a heavy sliding or rotating mass can be used to activate a similar switch, contact or value, by sizing the mass that upon experiencing certain ground motions the mass slides or rotates and activates a switch, contact or closes a valve prior to the arrival of the major destructive earthquake tremor.

SUMMARY OF THE INVENTION

The present invention provides a method and system for inhibiting the liquefaction of soil beneath a structure during an earthquake event.

Particularly, the present invention provides a seismic monitor that monitors the earth's movement and predicts the onset of an earthquake event. Based on that prediction, the system of the present invention controls a switch that activates a d-c potential difference across an array of electrodes buried in the ground beneath the structure and below the water table. The current flow by means of electro-osmosis negates the rise in pore water pressures induced by an earthquake event, and thus prevents soil liquefaction beneath a structure or works, such as a building, bridge, dam, excavation, runway or tailings pond. The electrodes are spatially located in the saturated soil beneath the structure to induce either ground water flow away from the foundation of the structure or towards pressure relief wells associated with the sink electrodes. The spatially locations of the electrodes and the applied d-c potential difference will vary depending on the soil conditions and the structure, but need to be sufficiently effective to reduce earthquake induced pore pressure to prevent liquefaction of the soils beneath the structure.

Particularly, the method of the present invention reduces the pore water pressure build up in these soils during an earthquake event by activating an electro-osmotic gradient away from the foundation of the structure or towards a series of pressure relief wells, and thus negate the impact of the earthquake shaking on raising the soil pore water pressure and hence maintain the soil shear strength and structural stability. The present invention can be installed in existing structures with minimal disruption and maintain structural stability of the foundation by preventing liquefaction of the sub-base soils during an earthquake event.

A seismic monitor can consist of a variety of devices provided they can predict the onset of major shear deforming ground motions associated with the major earthquake tremor from either early time arrival of higher frequency ground motions or the onset of strong ground motions. The seismic monitor may comprise an accelerometer connected to a computer running a predictive algorithm to activate the switch if ground motions of certain magnitude and frequency are experienced. The seismic monitor may also comprise a pendulum tuned to either activate or deactivate a contact if ground motions of certain magnitude and frequency are experienced. The seismic monitor may further comprise a sliding or rotating mass of sufficient mass to activate or deactivate a contact if ground motions of certain magnitude and frequency are experienced. The seismic monitor in all cases is designed to monitor ground movement and based on that ground movement predict the onset of a major earthquake tremor. When the seismic monitor has predicted the onset of a major earthquake tremor, the seismic monitor actuates a switch that connects the d-c power source to an array of electrical electrodes in the saturated ground, to induce ground water flow by electro-osmosis from the source electrodes to the sink electrodes and reduce the pore water pressure in the soil during the earthquake event. The seismic monitor's prediction of a major earthquake tremor generally only precedes the major earthquake tremor by a few seconds, so the d-c power source must be capable of energizing the electrodes within this time frame. Such d-c power sources may include lead acid batteries, a fly wheel generator, a quick start gas or diesel powered generator, or a combination thereof.

Upon energizing of the electrodes a timer is also activated, with the timer set to disengage the electrodes from the d-c power source only after sufficient time to ensure the electrodes remain energized throughout even the longest previously recorded earthquake duration. Upon de-energizing the electrodes the system is reset and the seismic monitor can re-activate and reenergize the electrodes in the event of following earthquake tremors. The d-c power source needs to be of sufficient capacity or re-chargeable to energize the electrodes at the power requirements and duration to ensure soil liquefaction does not occur during the earthquake event.

DETAILED DESCRIPTION

Figure 1:
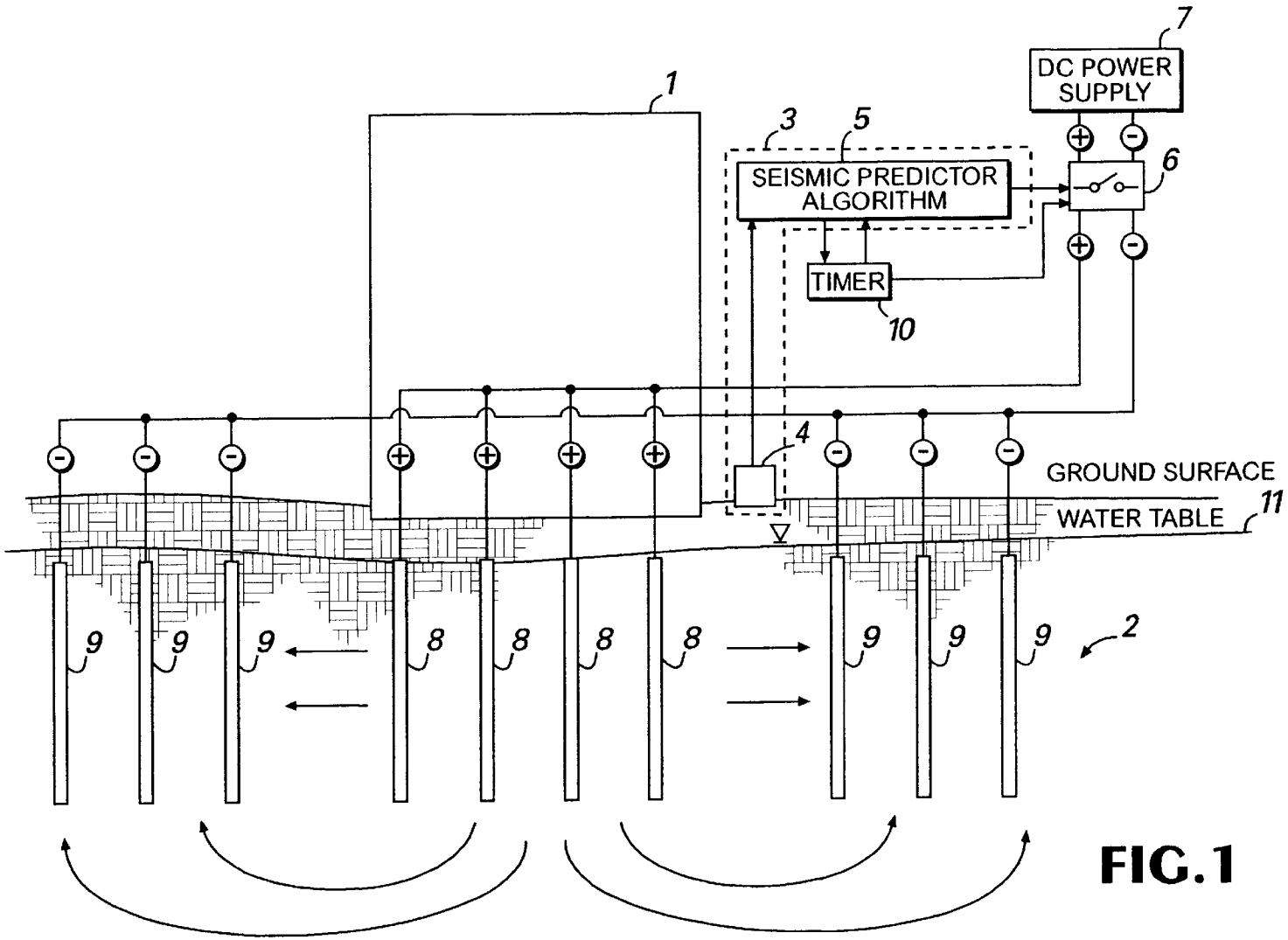
FIG. 1 is a cross sectional view showing one form of the invention for reducing pore water pressure beneath a structure during an earthquake event.

The present invention provides a method of preventing soil liquefaction beneath a structure or works by a seismic monitor which activates a electro-osmosis system in the sub-surface saturated soils beneath a structure, to reduce the pore water pressure rise associated with the shear reversal shaking of loose fine sediments during an earthquake event. One form of the invention is illustrated in cross section in FIG. 1, with a structure 1 constructed on a saturated soil 2 which is susceptible to liquefaction. A seismic monitor 3, comprises an accelerometer 4 and a computer 5 which runs an algorithm that, from the output signals of the accelerometer 4, predicts the onset of a major earthquake tremor from early arrival ground motion from minor earthquake tremors. The seismic monitor 3 is conventional in design and a number of algorithms exist for predicting the onset of a major earthquake tremor. Such monitors are disclosed in U.S. Pat. Nos. 4,884,030, 4,616,320, 4,300,135, 5,144,598, 5,420,380, 5,001,682, and 4,028,659, which disclosures are incorporated herein by reference. The seismic monitor 3 controls a switch 6 that in turn actuates the d-c power source 7 and energizes the electrical conductors both source electrodes 8 and sink electrodes 9. The seismic monitor 3 also activates a timer 10 which latches switch 6 in its closed condition for a predetermined time period so that the conductors remain energized throughout the major earthquake tremor. The time period is set based on the expected duration of the major earthquake tremors. After the timer 10 has timed out, the timer 10 de-energizes the conductors and re-sets both the switch 6 and the algorithm 5, so that the system can be re-triggered in the event of a later earthquake or tremor.

An array of electrical conductors 8 are connected between the positive output from the d-c power source and the soil 2 below the ground water table 11. A second array of electrical conductors 9 are connected between the negative output from the d-c power source and the soil 2 below the ground water table 11, and positioned in the soil with the positive conductors 8 for moving the ground water away from the structure foundation whereby lowering the soil pore water pressures during the major earthquake tremor and thus prevent liquefaction of the soil beneath the structure.

Figure 2:
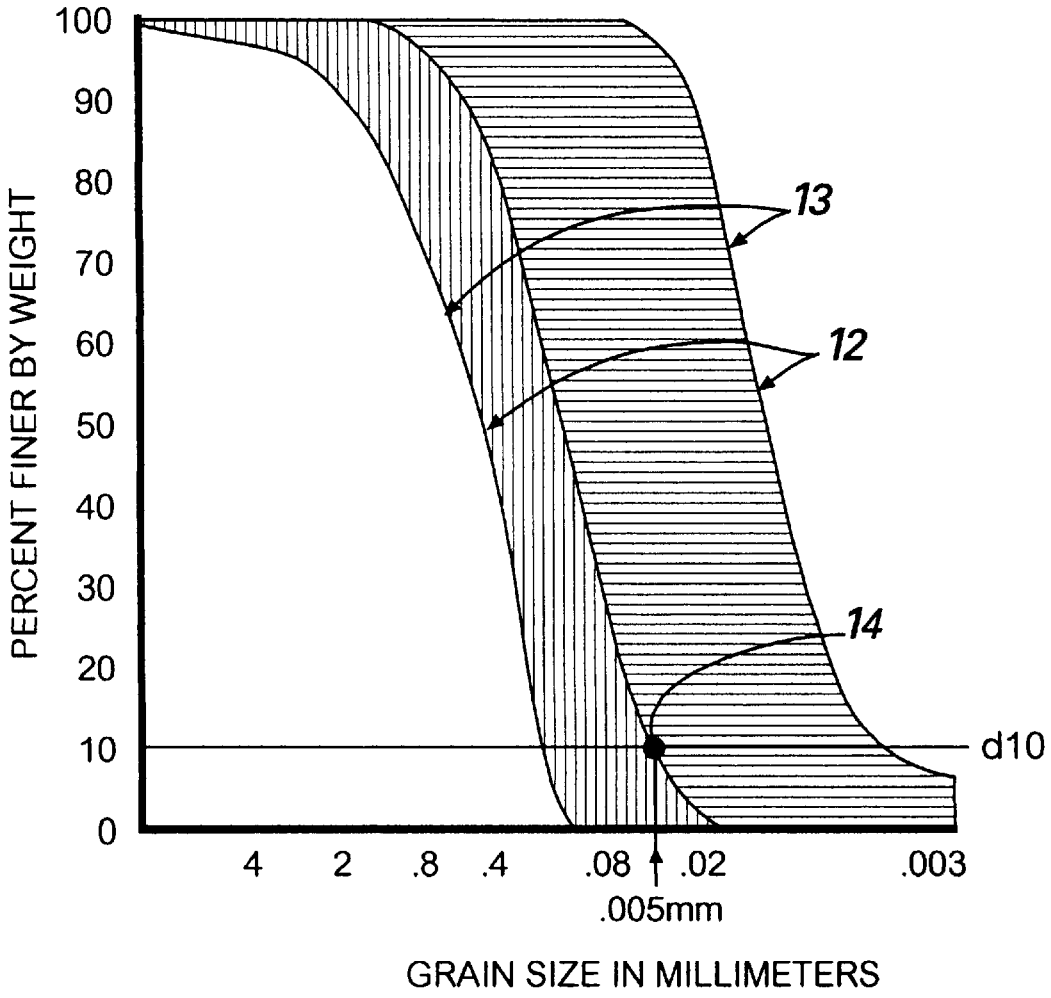
FIG. 2 is a grain size distribution envelop of a range of soils applicable to the current invention.

The present invention is applicable only to fine grained saturated soils, such as fine sands, silty sands and silts. The grain size distribution envelop of soils susceptible to liquefaction are shown in FIG. 2. The soils with a grain size distribution that lies within the envelop 12 are susceptible to soil liquefaction during an earthquake event. The soils applicable to electroosmosis and susceptible to soil liquefaction during an earthquake event are generally contain in the grain size distribution envelop 13. The present invention is applicable to these soils which are classified as d10 (10% finer) being less or equal to a grain size of 0.05 mm as shown by 14 in FIG. 2. That is, 10% by weight of the soil has a grain size equal to or less than 0.05 mm.

Figure 3:
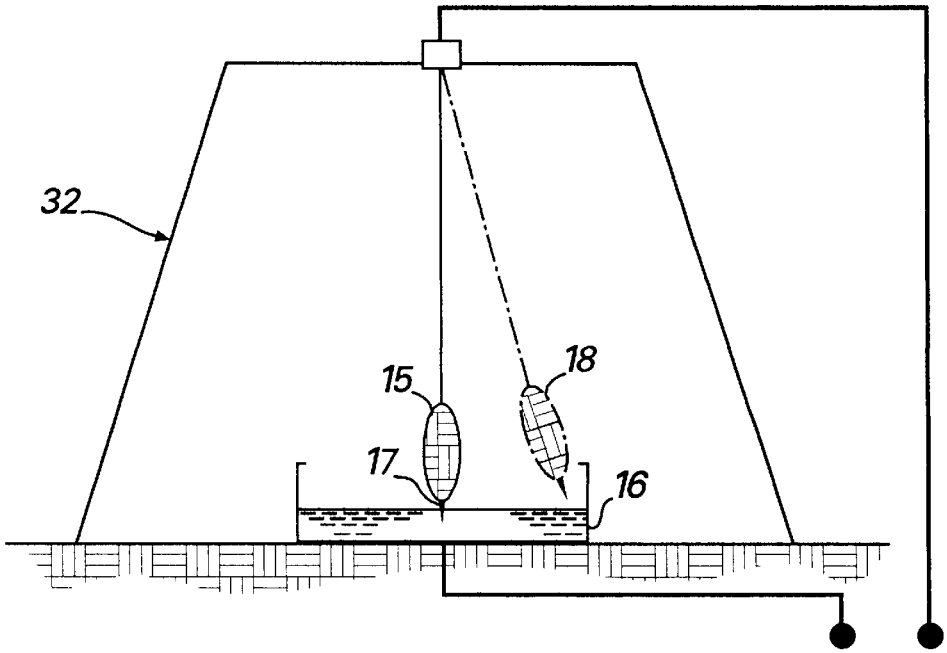
FIG. 3 is a cross sectional view of a pendulum seismically activated contact switch.

FIG. 3 illustrates an alternative seismic monitor 32 which replaces the accelerometer 4 and the computer 5 shown in FIG. 1. The seismic monitor 32 comprises a tuned mass pendulum 15 in contact with a conductive fluid 16 such as mercury when in its at rest position and is shown as a normally close contact 17. Upon the arrival of early ground motions and before the onset of the major earthquake tremor, the pendulum is excited into motion and opens the contact switch as given by the pendulum position designated as 18. The pendulum mass and length is preset to ensure the pendulum is excited by the early arrival ground motions proceeding the major earthquake tremor and before the soil has experienced significant shear strain reversals. The change in contact from normally closed to open activates the switch 6 that actuates the dc power source 7, starts the timer 10, and energizes the electrical conductors both source electrodes 8 and sink electrodes 9 as shown in FIG. 1. Consequently, the turned mass pendulum 15 servers to predict the onset of a major earthquake tremor.

Figure 4:
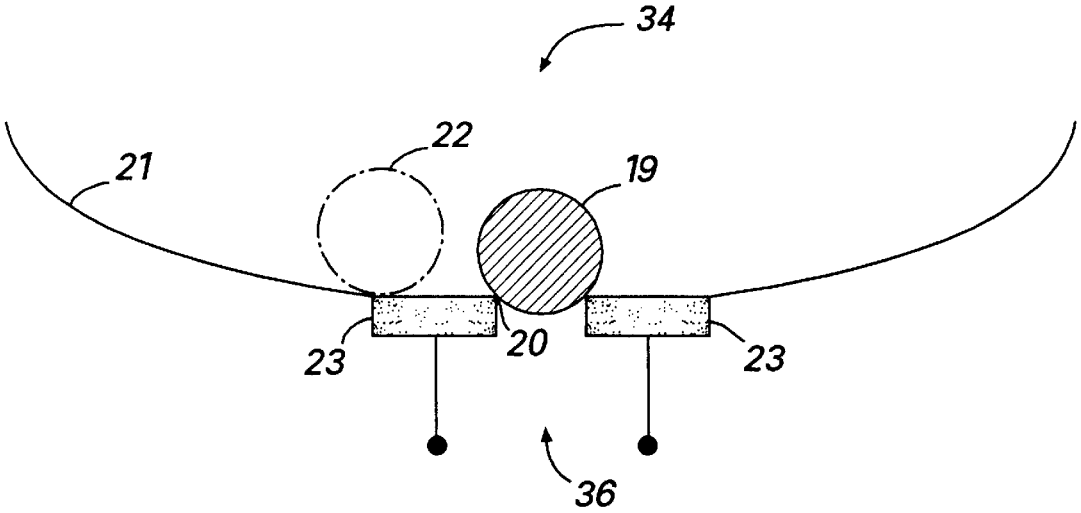
FIG. 4 is a cross sectional view of a rotating/rolling mass 10 seismically activated contact switch.

FIG. 4 illustrates another alternative seismic monitor 34 which replaces the accelerometer 4 and the computer 5 shown in FIG. 1. The seismic monitor 34 comprises a rotating mass metal ball 19 which electrically connects contacts 23, 23 at contact points 20, 20 to produce a normally close switch 36. Upon the arrival of early ground motions and before the onset of the major earthquake tremor, the ball 19 moves into the circular or sloping sides 21, to position 22, and out of contact with one of contacts 23, 23. At position 22, the normally close switch 36 is opened. The ball mass and the slope or radius of the sides 21 are preset to ensure the ball is excited and shifts laterally by the early arrival ground motions proceeding the major earthquake tremor and before the soil has experienced significant shear strain reversals. The change in contact from normally closed to open of normally close switch 36 activates the switch 6 that actuates the d-c power source 7, starts the timer 10, and energizes the electrical conductors both source electrodes 8 and sink electrodes 9 as shown in FIG. 1. Consequently, the turned mass pendulum 15 servers to predict the onset of a major earthquake tremor. In another form of the invention the ball is ferromagnetic and the contact switch is a magnet to ensure the ball does not shift laterally until a minimum threshold ground motion occurs. A sliding mass could also be used in place of the ball 19.

Figure 5:
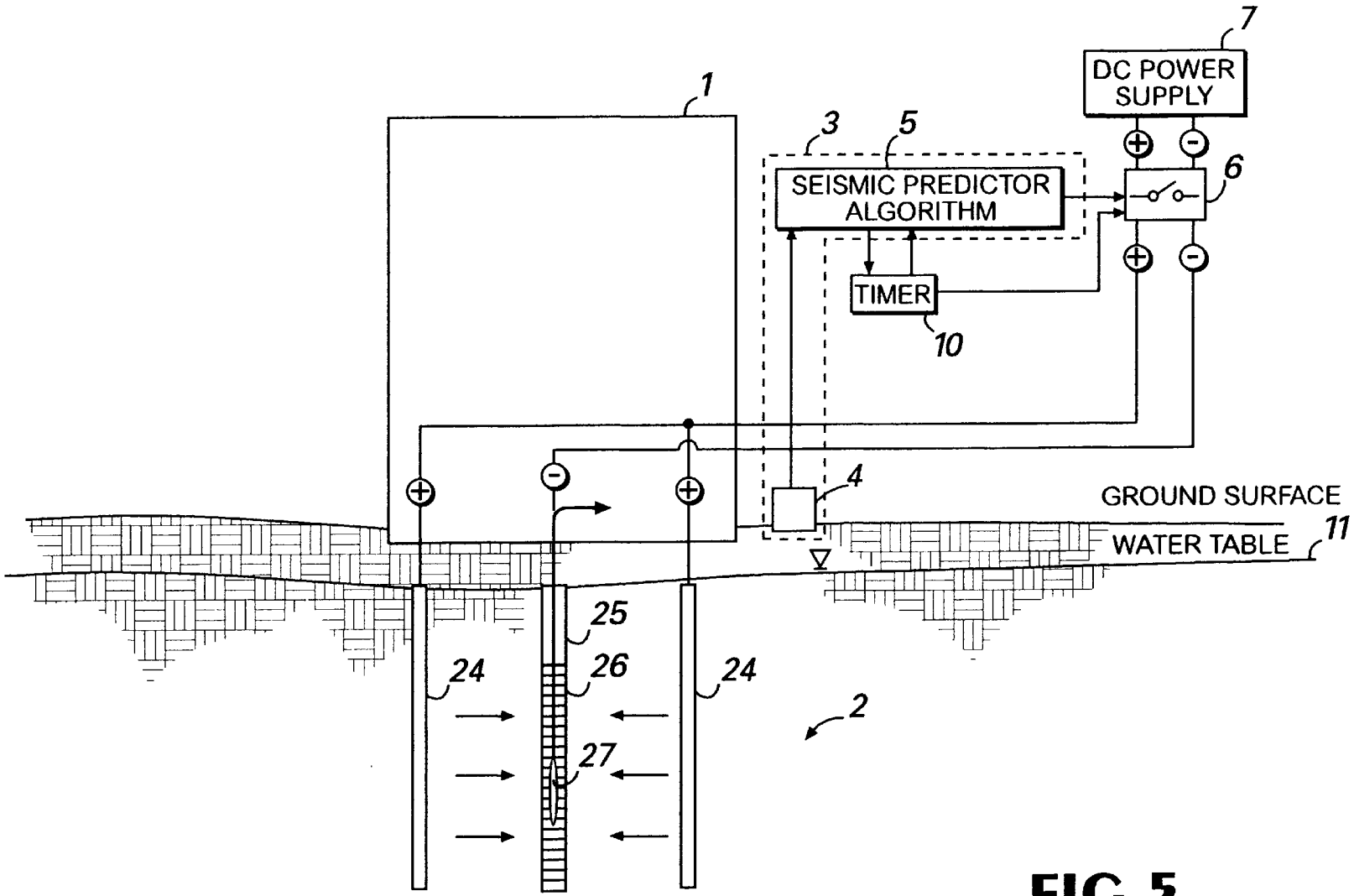
FIG. 5 is a cross sectional view showing another form of the invention with the sink electrodes (e.g. cathode electrodes) also being pressure relief wells for reducing pore water pressures beneath a structure during an earthquake event.
Figure 6:
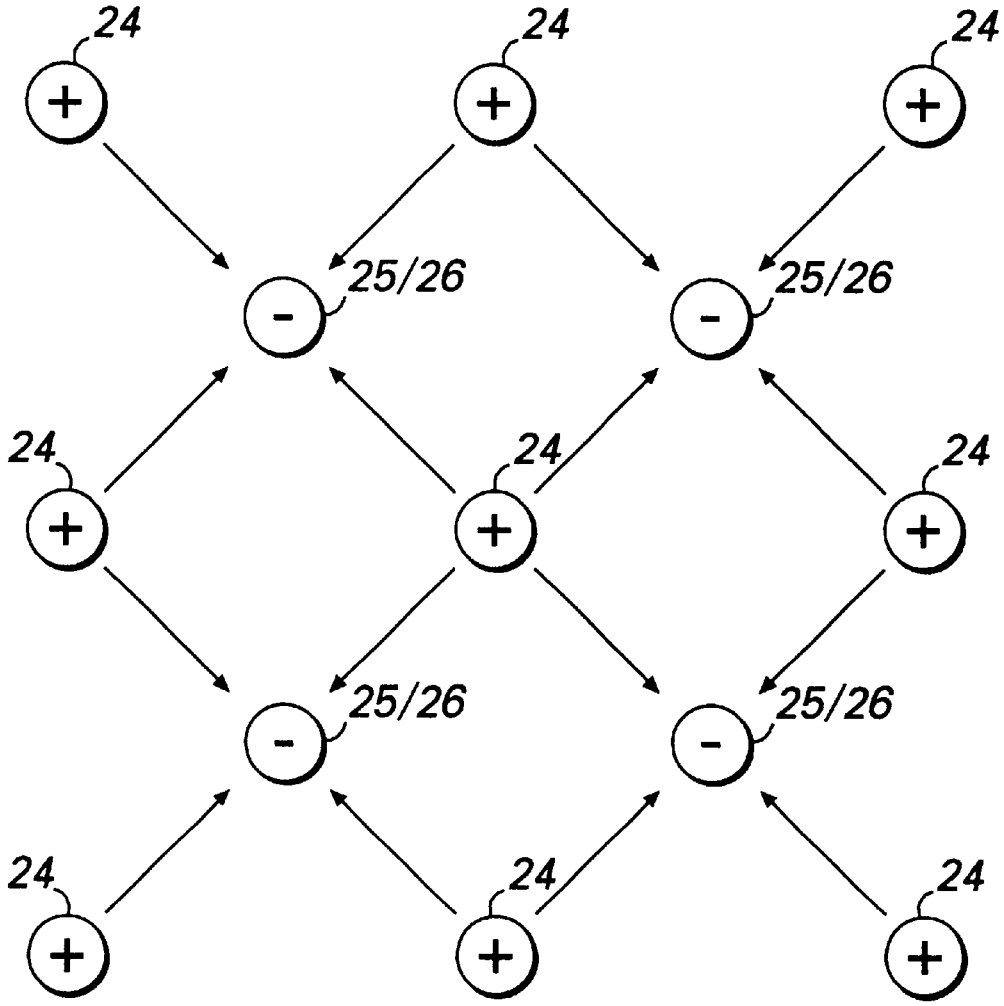
FIG. 6 is a plan view of source electrodes (e.g. anode electrodes) and sink electrodes (e.g. cathode electrodes)/ pressure relief wells as given in FIG. 5.

Referring now to FIG. 5 a further embodiment is shown in which the parts corresponding to those in FIG. 1 are identical and similarly numbered with the exception of the electrical conductors, source electrodes 24 and sink electrodes 25. Particularly, the sink electrodes 25 are located in pressure relief wells 26. In this form of the invention, the ground water is driven by the electro-osmotic gradient from the area beneath the structure towards the pressure relief wells 26. The soil pore water pressure beneath the structure will be most effectively reduced by this arrangement for particular soil deposits. The pressure relief wells 26 are evacuated such as by draining the collected ground water into a sump or by actively pumping the ground water to the service by pumps 27 during the major earthquake tremor. The pumps 27 are actuated by the switch 6 and powered by either the d-c power source 7 or an alternate power source. The arrangement of electrical conductors given in FIG. 5 is shown in plan view in FIG. 6, with the source electrodes 24 surrounding the sink electrodes 25 located within pressure relief wells 26. There is a plurality of arrangements and positions of the electrical conductors and pressure relief or drainage wells to achieve the desired soil pore water pressure reduction by electro-osmosis beneath a structure founded on saturated fine grained soils. The above arrangements are shown as illustrations of various form of the invention.

The present invention, therefore, is well adapted to carry out the objects and attain the ends and advantages mentioned as well as others inherent herein. While presently preferred embodiments of the invention are given for the purpose of disclosure, numerous changes in the details of construction, arrangement of parts, and the steps of the process will readily suggest themselves to those skilled in the art and which are encompassed within the spirit of the invention and the scope of the appended claims.

We claim:

1. A method of preventing liquefaction of soil beneath a structure during an earthquake event comprising:

monitoring the movements of the earth adjacent the structure;

from the movements of the earth, predicting the onset of an earthquake event; and in response to the prediction of an earthquake event, connecting a source of d-c power to an array of electrical conductors located in the soil beneath the structure and below the ground water table so that in response to connecting the d-c power to the electrical conductors in the soil, the ground water moves away from the structure thereby lowering the soil pore water pressure and preventing liquefaction of the soil beneath the structure.

2. The method of claim 1, wherein at least one of the electrical conductors is located in a pressure relief well which is evacuated during the earthquake event to ensure that the pore water pressure around the pressure relief wells does not rise sufficiently high to induce liquefaction of the soil beneath the structure.

3. The method of claim 1, wherein the method further comprises maintaining the connection of the d-c power source to the array of electrical conductors for a predetermined time relating to the expected duration of the earthquake event.

4. The method of claim 1, wherein the earth's movement is monitored by an accelerometer which produces output signals corresponding to the earth's movement and the onset of an earthquake event is predicted by means of a computer running an algorithm using the output signals.

5. The method of claim 1, wherein the earth's movement is monitored and the onset of earthquake events is predicted by a mechanical device comprising a pendulum mass that actuates or de-actuates a switch when subjected to early arrival ground motions preceding the onset of an earthquake event.

6. The method of claim 1, wherein the earth's movement is monitored and the onset of earthquake events is predicted by a mechanical device comprising a sliding mass that actuates or de-actuates a switch when subjected to early arrival ground motions preceding the onset of an earthquake event.

7. The method of claim 1, wherein the earth's movement is monitored and the onset of earthquake events is predicted by a mechanical device consisting of a rotating/rolling mass that actuates or de-actuates a switch when subjected to early arrival ground motions preceding the onset of an earthquake event.

8. A system for preventing liquefaction of soil beneath a structure during an earthquake event comprising:

a d-c power source;

an array of electrical conductors located in the soil beneath the structure and below the ground water table;

a switch interconnecting the d-c power source and the array of electrical conductors; and a seismic monitor for monitoring the movement of the earth adjacent the structure, and from the movement, predicting the onset of an earthquake event, wherein the seismic monitor activates the switch in response to predicting the onset of an earthquake event so that the d-c power source is connected to the conductors thereby causing the ground water beneath the structure to move away from the structure, lowering the soil pore water pressure, and preventing liquefaction of the soil beneath the structure.

9. The system of claim 8, wherein at least one of the electrical conductors is located in a pressure relief well which is evacuated during the earthquake event to ensure the pore water pressure around the pressure relief wells does not rise sufficiently high to induce liquefaction of the soil.

10. The system of claim 8, wherein the system further comprises a timer, connected between the seismic monitor and the switch, which timer is activated by the seismic monitor in response to the prediction of the onset of an earthquake event, and which timer maintains the connection of the d-c power source to the array of electrical conductors for a predetermined time relating the expected duration of the earthquake event.

11. The system of claim 8, wherein the seismic monitor comprises an accelerometer for monitoring the earth's movement and for producing output signals corresponding to such movement and a computer adapted to run an algorithm which uses the output signals to predict the onset of an earthquake event.

12. The system of claim 8, wherein the seismic monitor comprises a mechanical device comprising a pendulum mass that actuates or de-actuates a switch when subjected to early arrival ground motions preceding the onset of an earthquake event.

13. The system of claim 8, wherein the seismic monitor comprises a mechanical device comprising a sliding mass that actuates or de-actuates a switch when subjected to early arrival ground motions preceding the onset of an earthquake event.

14. The system of claim 8, wherein the seismic monitor comprises a mechanical device consisting of a rotating/rolling mass that actuates or deactuates a switch when subjected to early arrival ground motions preceding the onset of an earthquake event.

* * * * *